US008393557B2

(12) United States Patent
Schindler et al.

(10) Patent No.: US 8,393,557 B2
(45) Date of Patent: Mar. 12, 2013

(54) METHOD FOR MANUFACTURING FINE MINERAL POWDER PRODUCTS

(75) Inventors: Ulrich Schindler, Niederstotzingen (DE); Christoph Bauer, St. Georgen (AT); Giselbert Bauer, legal representative, St. Georgen (AT); Annemarie Bauer, legal representative, St. Georgen (AT)

(73) Assignee: Omya Development AG, Oftringen (CH)

( * ) Notice: Subject to any disclaimer, the term of this patent is extended or adjusted under 35 U.S.C. 154(b) by 576 days.

(21) Appl. No.: 12/514,175

(22) PCT Filed: Nov. 12, 2007

(86) PCT No.: PCT/DE2007/002035

§ 371 (c)(1), (2), (4) Date: Jun. 14, 2010

(87) PCT Pub. No.: WO2008/055495

PCT Pub. Date: May 15, 2008

(65) Prior Publication Data

US 2010/0294863 A1 Nov. 25, 2010

(30) Foreign Application Priority Data

Nov. 10, 2006 (DE) ..... 10 2006 053 356

(51) Int. Cl.
*B02C 23/00* (2006.01)

(52) U.S. Cl. ..... 241/19; 241/79.1

(58) Field of Classification Search ..... 241/19, 241/79.1

See application file for complete search history.

(56) References Cited

U.S. PATENT DOCUMENTS

| | | | |
|---|---|---|---|
| 3,565,349 | A | 2/1971 | Deynat |
| 8,070,080 | B2 * | 12/2011 | Schlesinger et al. ..... 241/19 |

FOREIGN PATENT DOCUMENTS

| | | |
|---|---|---|
| DE | 1197734 | 7/1965 |
| DE | 1804158 | 4/1970 |
| DE | 2642884 | 3/1978 |
| DE | 3040996 | 6/1982 |
| DE | 19806895 | 9/1999 |
| EP | 0037066 | 10/1981 |
| EP | 0341417 | 11/1989 |
| FR | 1585405 | 1/1970 |
| GB | 953690 | 3/1964 |
| GB | 2014711 | 8/1979 |
| JP | 2003088810 | 3/2003 |

* cited by examiner

*Primary Examiner* — Faye Francis

(74) *Attorney, Agent, or Firm* — 24IP Law Group; Timothy R. DeWitt

(57) ABSTRACT

A method for manufacturing fine mineral powders using systems that include one or more air classifiers, dust separators like cyclones and/or filters, at least one ventilator and instruments connecting tubes or pipes for the transport of air. The relative humidity of air in the air classifier is kept in a range between 15% to 35%.

11 Claims, 6 Drawing Sheets

METHOD FOR MANUFACTURING FINE MINERAL POWDER PRODUCTS

Figure 1:
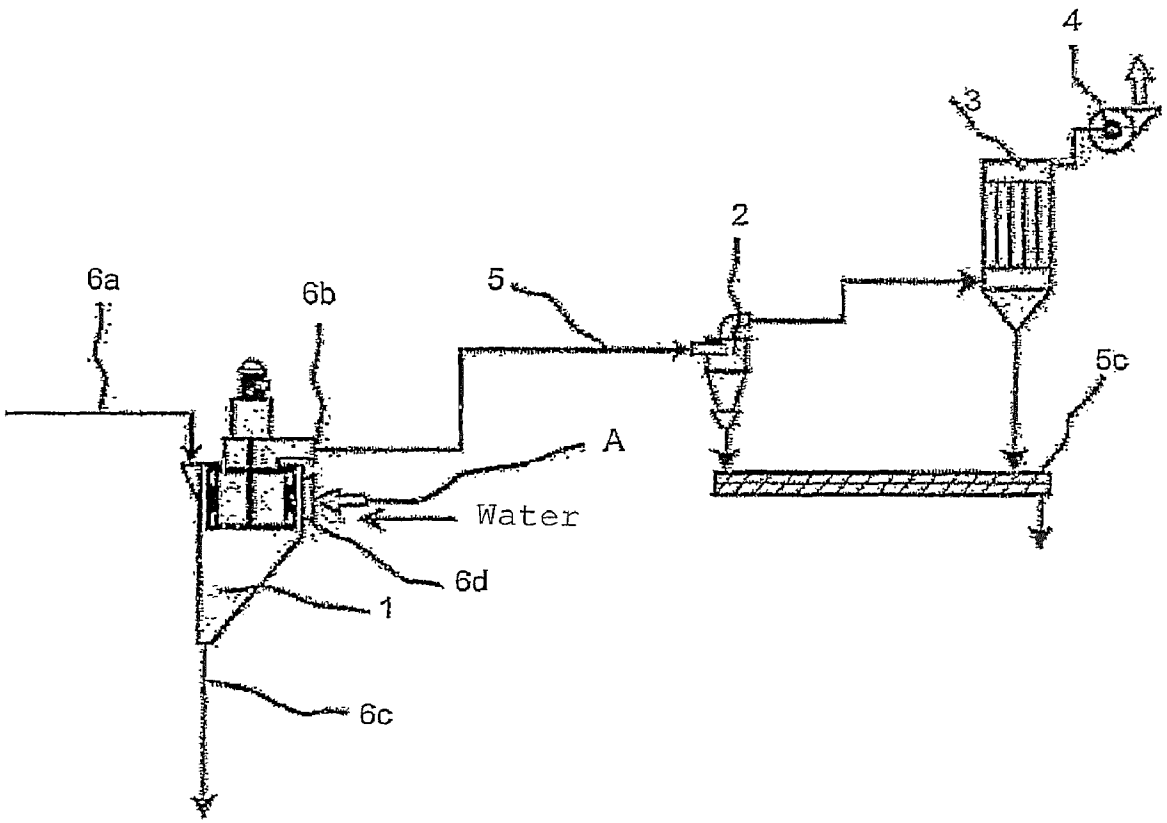

The Invention relates to a method for manufacturing fine mineral powders using systems, consisting of one or more air classifier, dust separators like cyclones and/or filters, at least one ventilator as well as these instruments connecting tubes or pipes for the transport of air and solid material.

It is possible to use different kinds of air classifier like zig-zag classifier, circulation air classifier, spiral or guide rod classifier.

Especially during the classification of $CaCO_3$ with an average particle size below about 5 μm in air classifier systems hard and solid deposits can be observed prevalently at the walls of the parts of a system that get in contact with the air/powder mixture like the air classifier itself, the tubes or pipes transporting air or finely granulated powders and other parts of the system like cyclones, filters or ventilators. These deposits grow to shelly coverings (so-called "eggshells"), but also to dentoid structures until they chip off from the walls and contaminate the finely granulated product that has been specified with respect to coarse residues. This can cause complaints leading to losses with a high economical impact.

These residues (in the following as "Eggshells" designated) cause also unbalances at rotating parts of the air classifier system like the classifier rotors and the ventilator rotors leading to a restricted use or rather high costs for cleaning and/or balancing.

EP 0037066 and DE 2642884, claim 8, disclose mechanical devices for cleaning static parts, but this is with respect to the construction of the instrument technically most demanding and leads to frequent interruptions of use. Besides this it is possible that eggshell particles will chip off before or after cleaning.

The contaminated products are often separated from the coarse particles by a further classifying or filtering step.

These measures are very circumstantial and connected to additional technical equipment and partly high energy consumption, so that is not possible to prevent the powder products from contamination by Eggshells cost-efficiently and permanently, especially not in the interesting range of a temperature of the classifier air below 100° C.

Therefore, the object of the present invention is to avoid the mentioned deposits and the connected inconveniences. The surprising solution of this objective is to keep the relative humidity (rF) of the classifier air in the range of about 15% up to about 50%, preferentially 15% up to about 35%. In order to achieve this, the rF will be measured in the classifier—and/or other positions of the system—and depending on the respective data water will be introduced into the classifier air.

The applicant has observed, that eggshells occur increasingly when the classifier air has a rF below 15%. Therefore the rF of the classifier air will be kept according to the invention above a value of about 15%.

The applicant has furthermore realized, that much higher values of the rF above 50% require a much higher amount of water increasing the risk that the dew point will be under run at positions of the system with a lower temperature. This would lead to the formation of liquid water and consequently to the formation of agglomerates or slurry which will lead to a break down of the process. In order to avoid this 50% rF shall not be exceed.

On this the following has to be noted: The cool fresh air that is suctioned from the surrounding will be warmed up in the classifier. This has to be done especially when one part of the (warmer) air from the classifier is fed back from behind the filter to the classifier air inlet. Thereby the relative humidity of the classifier air will decrease in the classifier depending on the temperature of the fresh air and humidity of the fresh air, to values of below 10% rF. This applies specially for arid areas, where the surrounding air is inherently very dry, like for instance in Arizona/U.S. with an average annual humidity of 14%. The dryer the classifier air is, the dryer are the particles within it. One should expect that less particles will sediment through the walls, the dryer the particles and the walls are. Since dryer particles are harder and more prude, they should attach less easily at the walls while damp particles damp particles can attach more easily due to interstice liquid, thus a humidification would be counterproductive. Tests showed in contrast to this expectation, that—as already mentioned—eggshells form increasingly below a relative humidity of about 15%, but above a relative humidity of about 15% in the classifier air nearly no or no eggshells can be observed in or behind the outlet of the classifier, leading to less or no coarse material within the finely granulated material.

It was not possible to explain this phenomenon scientifically. The applicant was able to show in experiments that the eggshells are formed mainly by very small particles with a size of several nm and it is supposed that this is related to the tribo-electrical-charge of the mineral particles. By this mainly very small particles are and will be kept dispersed and can attach then to the walls due to the high surface forces (the larger the surface is, the larger are the surface forces) and agglomerate to the eggshells. According to the invention the relative humidity of the classifier air will be increased resulting in an increase of conductivity, whereby charges can be equalized more rapidly and finest particles in the range of some nanometres in the surrounding air will reagglomerate to bigger particles instead of attaching to the walls.

As already mentioned the relative humidity should not be raised above 35% as the costs would be to high and the benefit to low.

Furthermore it became surprisingly apparent, that the use of the invention—at constant conditions for the mass flow of the feedstock, the properties of the feedstock, the classifier airflow (and for centrifugal guide rod classifiers the rotor speed)—the mass flow of the finely granulated product and by this the so-called recovery of finely granulated product (relation of mass flow of finely granulated particles below defined particle size and the mass flow of particles below the particle size in the feedstock) is increased dramatically. This means that the reduced energy consumption for producing a defined amount of product results in cost benefits and protects the environment.

Preferably the adjustment of the relative humidity is carried out before their entry into the classifier. A quite simple embodiment of the invention is to inject vapour into the inlet for fresh air. (Claim 2, FIG. 1)

In order to facility the injection the water can be injected under high-pressure from 60 to 115 bar with a droplet size below 30 μm into the inlet channel. (Claim 3)

Further the water can be heated to a temperature between 50° C. and 90° C. (Claim 4)

It is advantageously that the inlet channel is dimensioned to attain an air speed between 1 m/s and 3 m/s. (Claim 5)

According to another embodiment of the invention the classifier air is directed through a device for humidification of the air in order to introduce the appropriate amount of water (Claim 6)

Preferably the device for humidification is at least a tube or pipe made of water permeable material through that the water is directed and over whose surface the classifier air is directed (Claim 7). Thereby the water gets from the inside of the tube or pipe through the outside, were the passing air flow will take it up.

Such a device can be obtain for instance form AWS Air Water Systems AG in Villach, Austria.

Another embodiment of the invention is characterized by feeding back of the majority of the outlet air of the filter through the inlet of the air classifier and the humidification takes place in the return channel. (Claim 8, FIG. 4)

This can be done easily in a way that the addition of water is regulated through the humidity of the outlet air, their temperature and the temperature of the air in the air classifier. (Claim 9)

As mentioned at the beginning, in practice the temperature of the classifier air is in the range below 100° C. In this regard another improvement of the invention will be achieved by keeping the temperature of the air of the classifier in a range between 30° C. and 80° C. In this range of temperature is the effort to humidify the air relatively low, meaning the required amount of water and necessary energy for their introduction.

This will be achieved advantageously via the relation of return air and the temperature of the introduced water. (Claim 10).

The feedstock can be introduced from a pre-grinding-product-silo or directly from an upstream arranged dry mill with or without conveying air.

In case that a dry mill is arranged immediately upstream of the classifier, advantageously the outlet air of the mill can be introduced into the air classifier and the humidification of the air can take place in front of the mill (as mentioned in the method according to claims 2 to 4) (Claim 11).

The invention will be describe more detailed by the following figures.

Figure 2:
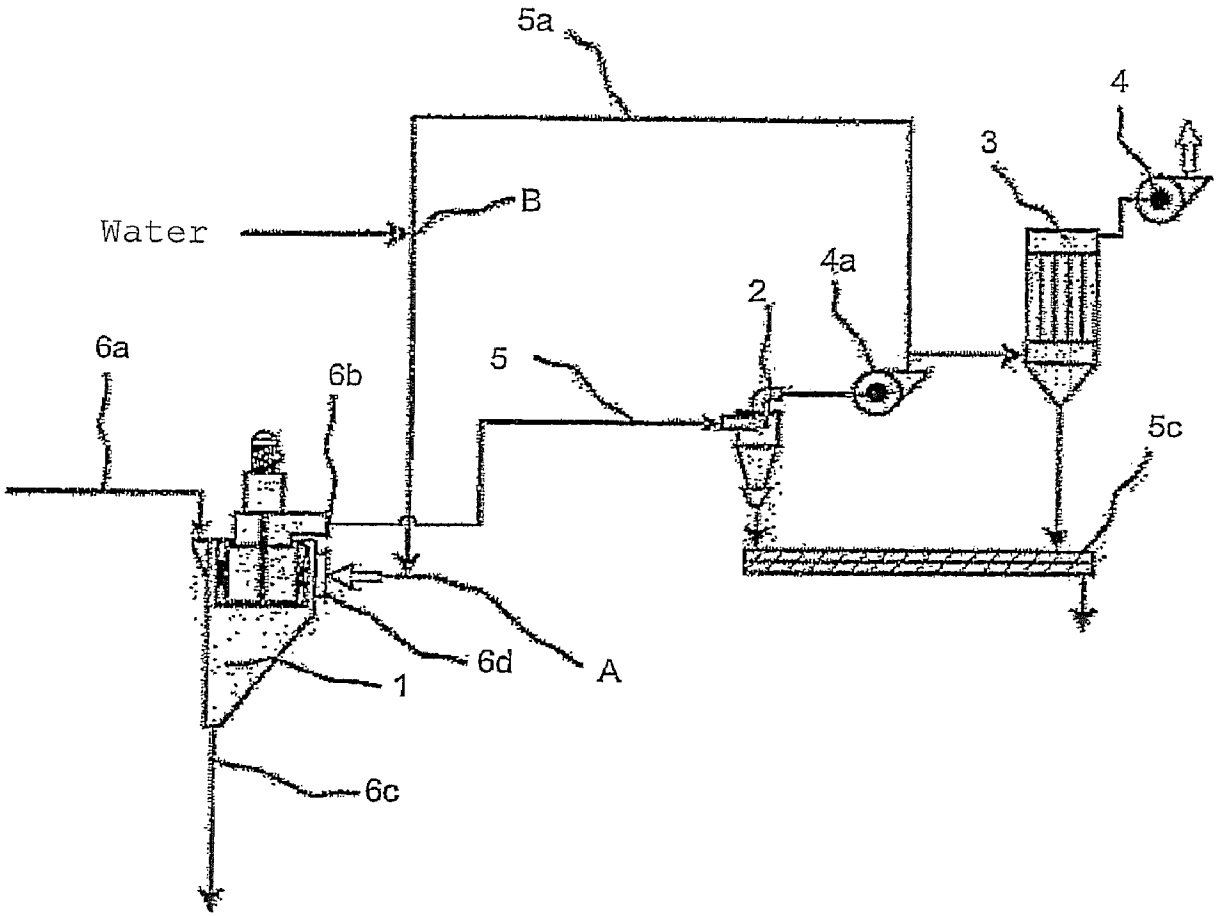
Figure 3:
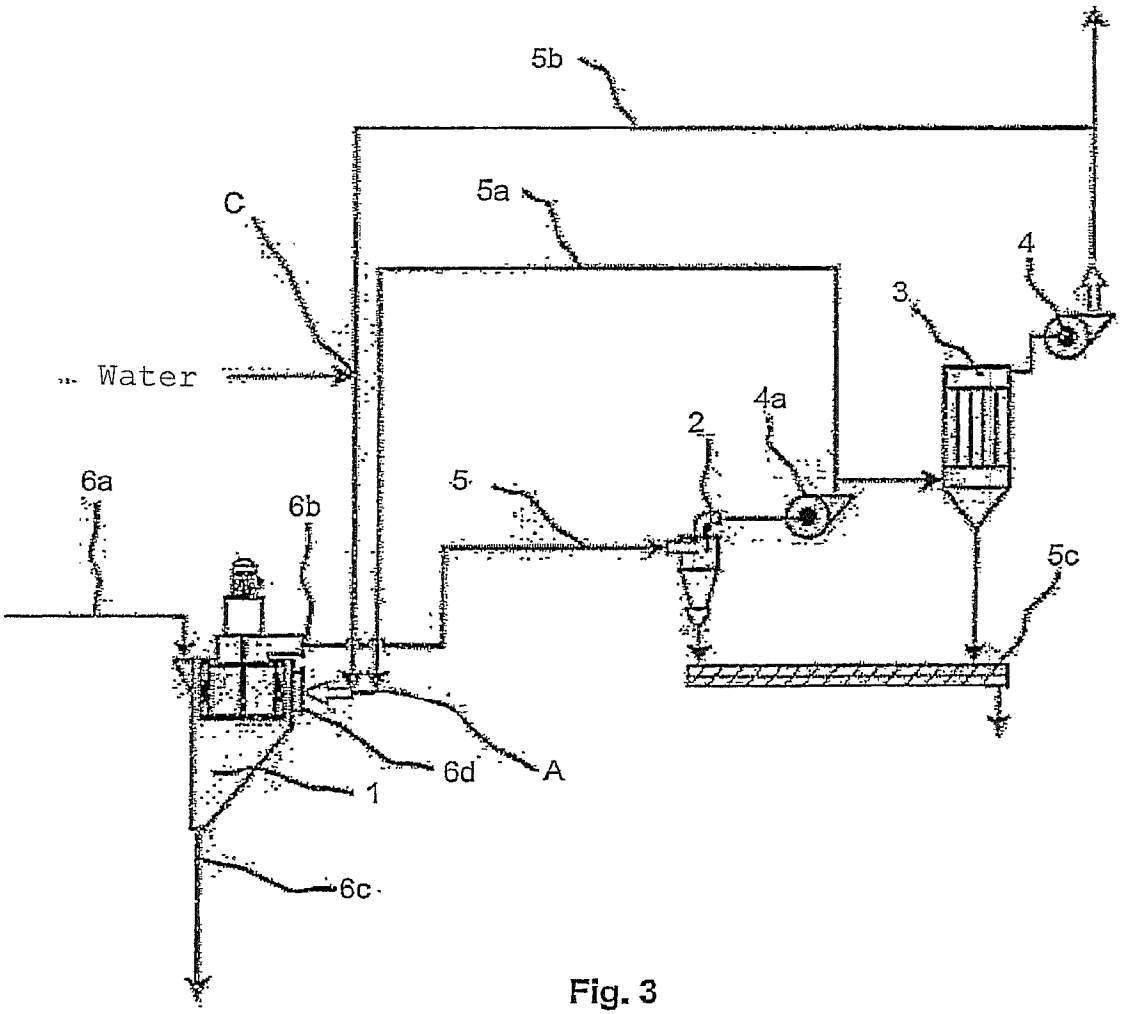
Figure 4:
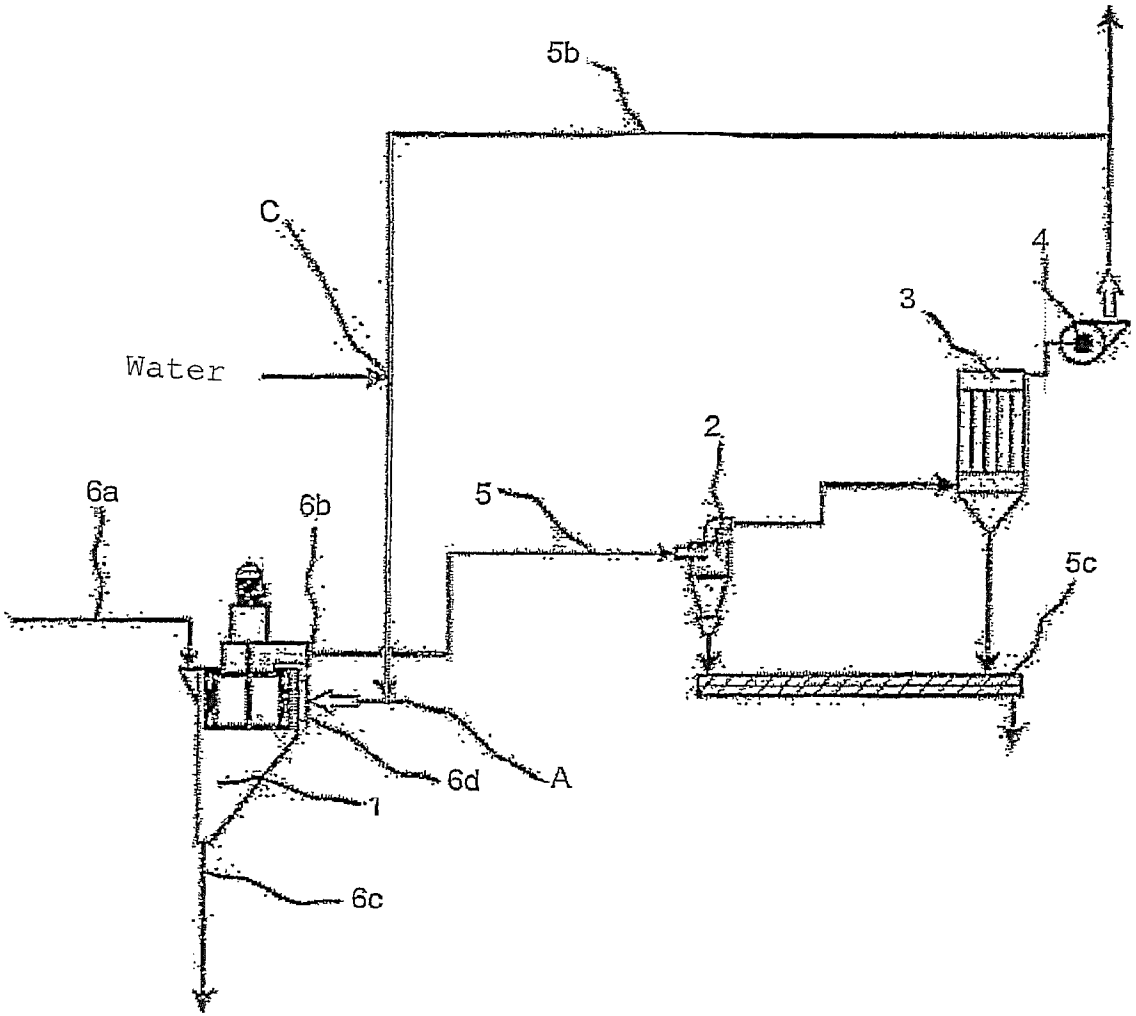
Figure 5:
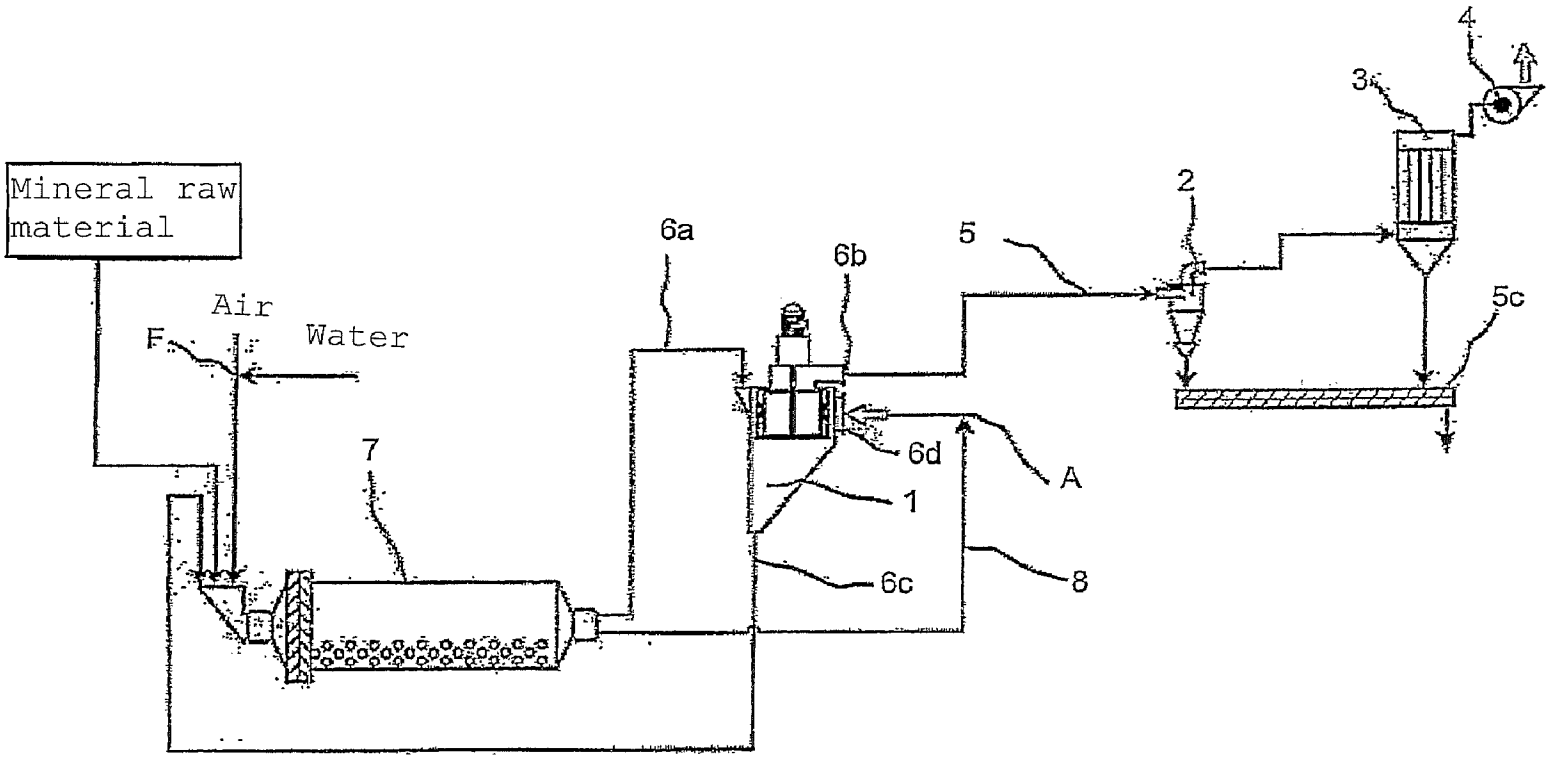
Figure 6:
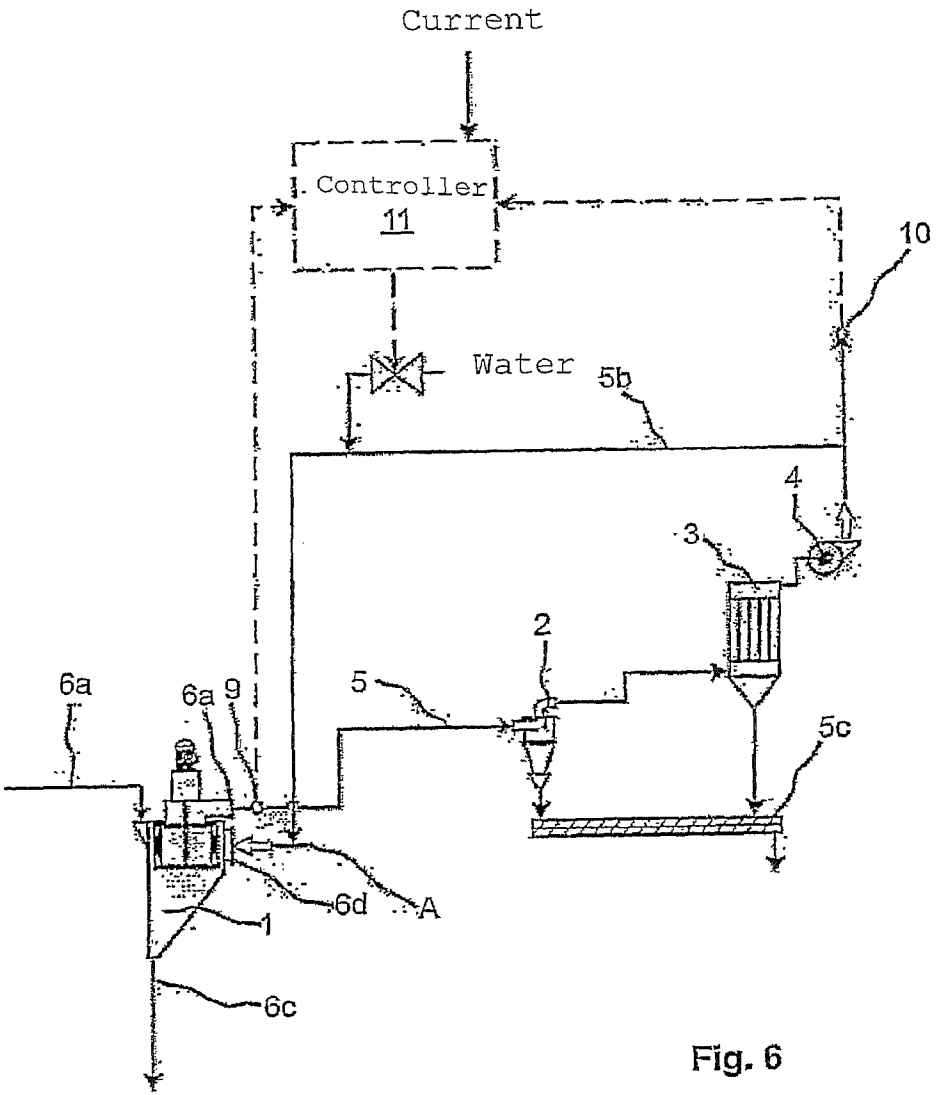

FIG. 1 shows an embodiment with a simple arrangement of an air classification system, FIG. 2 shows an embodiment, wherein a partial flow of the cyclone leaving air/powder mixture is fed back to the inlet of the air classifier, FIG. 3 shows an embodiment, wherein as well as a partial flow of the cyclone leaving air/powder mixture as well as a partial flow of the filter outlet air is fed back to the inlet of the air classifier, FIG. 4 shows an embodiment, wherein only a partial flow of the filter outlet air is fed back to the inlet of the air classifier, FIG. 5 shows an embodiment, wherein a dry mill is arranged immediately before the air classifier, and FIG. 6 shows an embodiment with regulation of the humidity of the air in the air classifier.

In general an air classifier system (FIG. 1) consists of an air classifier 1, a cyclone 2, a filter 3, a ventilator 4, the pipes or tubes 5 connecting these parts as well as the in- and outlet devices for feeding 6*a*, finely granulated 6*b* and coarse material 6*c*. In the air classifier 1 the feedstock is separated into coarse material and finely granulated material. The coarse material will be let out through the coarse material outlet 6*c*. In the cyclone 2 the finely granulated material, that represents usually the desired powdery product, will be separated from the classifier air and transported via the conveying screw 5*c*. The classifier respectively cyclone outlet air will be dedusted and exhausted by the ventilator 4 through the surrounding, the finely granulated dust will be directed through the conveying screw. The inlet for fresh air 6*d* can be arranged directly at the housing of the classifier or at an upstream arranged fresh air inlet channel. Depending on the construction of the air classifier so-called leak air enters the air classifier for the purpose of sealing.

According to the invention the relative humidity of the classifier air will be kept in a range from 15% to 35%. According to FIG. 1 water will be injected for this purpose in form of vapour or droplets into the aspirated fresh air at position A, namely into the fresh air inlet 6*d*.

FIG. 2 shows an embodiment, wherein in a known manner a partial flow of the cyclone 2 behind a cyclone ventilator 4*a* leaving air/powder mixture is fed back through tubes or channels 5*a* to the fresh air inlet 6*d* of the air classifier. It has been found advantageously, to add the water necessary for humidification and cooling of the classifier air at position B, namely into the connecting pipe between cyclone ventilator 4*a*, since a sufficient distance for evaporation is given. However, water can be successfully injected directly into the fresh air inlet 6*d* with this connection.

FIG. 3 shows an embodiment, wherein as well as a partial flow of the cyclone leaving air/powder mixture a partial flow of the filter outlet air 5*b* is fed back to the fresh air inlet 6*d* of the air classifier. It turned out advantageously to bring in the water necessary for humidification and cooling into the backflow air from the filter 3 at position C, namely the connecting pipe between ventilator 4 and the fresh air inlet 6*d*, because nearly no dust particles are present in the return air, that could eventually coagulate as droplets and than as coarse and humid particles interfering with the process. However, water can be successfully injected directly into the fresh air inlet 6*d* with this routeing of air flow.

According to the embodiment shown in FIG. 4 only a partial flow of the outlet air of the filter will be fed back to the fresh air inlet 6*d* of the air classifier 1. It turned out as an advantage to bring in the water necessary for humidification and cooling in the return air 5*b* at position C, namely the connecting pipe 5*b* between ventilator 4 and fresh air inlet 6*d*.

According to FIG. 5 the air classifier is directly linked to a ventilated mill 7 and the outlet air of the mill is directed through the pipes 8 to the fresh air entry of the classifier. In this regard it is advantageously to humidify the air already at the entry of the mill. This measure can also be linked to the before mentioned embodiments.

FIG. 6 describes basically the regulation according to the invention in the embodiment shown in FIG. 4. The relative humidity and the temperature of the classifier outlet air will be measured behind the filter ventilator 4 via sensors 10, and the temperature of the air at the outlet of the classifier via sensors 9. The relative humidity can be measured better in dust free air. Derived from this data the relative humidity in the classifier itself will be calculated in the controller 11 based on the known relationship between temperature and waterload and according to this the addition of water to the return air pipe 5*b* will be adjusted in a way that the desired relative humidity in the classifier will be obtained.

With devices according to the proceeding figures several different tests have been performed leading to the following results.

1. Classification Parameter for an Experiment with Conditioned Air:

| | |
|---|---|
| Classifier speed: | 3000 U/Min |
| Air flow: | 15000 m3/h |
| Air temperature: | 60° C. |
| Relative humidity: | 30% |
| Absolute water content: | 39 g/m$^3$ |
| Product mass flow: | 2.75 t/h |
| Grain size of prod. at 2 μm: | 61.30% |

After one hour process no eggshell formation was observed at the inspection door of the system.

2. Classification Parameter for an Experiment with No-Conditioned Air:

| | | |
|---|---|---|
| Classifier speed: | 3000 U/Min | 3000 U/Min |
| Air flow: | 15000 $m^3/h$ | 15000 $m^3/h$ |
| Air temperature: | 60° C. | 60° C. |
| Relative humidity: | 6% | 3% |
| Absolute water content: | 7.8 $g/m^3$ | 3.3 $g/m^3$ |
| Product mass flow: | 2.85 t/h | 1.6 t/h |
| Grain size of prod. at 2 μm: | 61.90% | 54.90% |

After one hour process eggshell formation was observed at the inspection door of the system 3. Classification Parameter for an Experiment with Conditioned Air:

| | |
|---|---|
| Classifier speed: | 3000 U/Min |
| Air flow: | 9000 $m^3/h$ |
| Air temperature: | 42° C. |
| Relative humidity: | 35% |
| Absolute water content: | 19.7 $g/m^3$ |
| Product mass flow: | 0.6 t/h |
| Grain size of prod. at 2 μm: | 81.70% |

After one hour process no eggshell formation was observed at the inspection door of the system 4. Classification Parameter for an Experiment with No-Conditioned Air:

| | | |
|---|---|---|
| Classifier speed: | 3000 U/Min | 3000 U/Min |
| Air flow: | 9000 $m^3/h$ | 9000 $m^3/h$ |
| Air temperature: | 44° C. | 40° C. |
| Relative humidity: | 11% | 7% |
| Absolute water content: | 6.7 $g/m^3$ | 3.7 $g/m^3$ |
| Product mass flow: | 0.55 t/h | 0.15 t/h |
| Grain size of prod. at 2 μm: | 82.30% | 81.30% |

After one hour process slight eggshell formation was observed at the inspection door of the system 5. Classification Parameter for an Experiment with Conditioned Air:

| | |
|---|---|
| Classifier speed: | 1800 U/Min |
| Air flow: | 12000 $m^3/h$ |
| Air temperature: | 45° C. |
| Relative humidity: | 35% |
| Absolute water content: | 21.5 $g/m^3$ |
| Product mass flow: | 4.35 t/h |
| Grain size of prod. at 2 μm: | 43.10% |

After one hour process no eggshell formation was observed at the inspection door of the system 6. Classification Parameter for an Experiment with No-Conditioned Air:

| | | |
|---|---|---|
| Classifier speed: | 2000 U/Min | 2000 U/Min |
| Air flow: | 12000 $m^3/h$ | 12000 $m^3/h$ |
| Air temperature: | 44° C. | 45° C. |
| Relative humidity: | 11% | 5% |
| Absolute water content: | 6.8 $g/m^3$ | 3.3 $g/m^3$ |

-continued

| | | |
|---|---|---|
| Product mass flow: | 3.4 t/h | 2.7 t/h |
| Grain size of prod. at 2 μm: | 50.70% | 42.50% |

After one hour process first indications for eggshell formation were observed at the inspection door of the system.

REFERENCE NUMBER LIST

| | |
|---|---|
| 1 | Air classifier |
| 2 | Cyclone |
| 3 | Filter |
| 4 | Ventilator |
| 4a | Cyclone ventilator |
| 5/5a | tube |
| 5b | Tube from Filter 3 to Air Classifier 1 |
| 5c | Conveying Screw |
| 6 | In- and Outlet |
| 6a | Feedstock inlet |
| 6b | Finely granulated material outlet |
| 6c | Coarse material outlet |
| 6d | Fresh air inlet |
| 7 | Dry mill |
| 8 | Pipe between mill 7 and fresh air inlet 6d |
| 9 | Temperature sensor |
| 10 | Temperature sensor and humidity sensor |
| 11 | controller |

The invention claimed is:

1. A method for manufacturing fine mineral powders using a system comprising an air classifier having an inlet duct, a dust separator, and at least one ventilator, comprising the steps of:

measuring relative humidity in the system; and if the humidity is less than 15% introducing water into air in the classifier to raise the relative humidity in the system above 15%; and if the humidity is greater than 35% introducing dry air to reduce the relative humidity in the system to below 35%.

2. A method according to claim 1, wherein said step of introducing water into the air classifier comprises injecting vapour in the inlet duct.

3. A method according to claim 1, wherein said step of introducing water into the air classifier comprising injecting water under high pressure from 60 to 115 bar with a droplet size <30 μm into the inlet duct.

4. A method according to claim 3, wherein the water is heated to a temperature between 50° C. to 90° C. before injection.

5. A method according to claim 3, wherein the inlet duct is dimensioned to attain an air speed between 1 m/s to 3 m/s is reached.

6. A method according to claim 1, wherein said step of introducing water comprises directing the classifier air through an air humidification device in order to introduce the appropriate amount of water.

7. A method according to claim 6, wherein the air humidification device comprises a tube or pipe made of water permeable material through that the water is directed and over whose surface the classifier air is directed.

8. A method according to the claim 1, wherein the majority of the outlet air of the dust separator is fed back into the inlet duct of the air classifier and the humidification takes place in the return channel.

9. A method according to the claim 1, wherein the addition introduction of water is regulated through the humidity of outlet air, air temperature and the temperature of the air in the air classifier.

10. A method according to the claim 1, wherein the temperature of the air in the air classifier is kept via the relation of return air and the temperature of the introduced water in a range between 30° C. and 80° C.

11. A method according to claim 1, wherein a dry mill is arranged immediately upstream of the air classifier and the outlet air of the mill is introduced into the air classifier wherein the humidification of the air takes place in front of the upstream arranged mill.

* * * * *